United States Patent [19]

Gindel

[11] 4,226,193

[45] Oct. 7, 1980

[54] SHELF ASSEMBLY

[75] Inventor: Alvin Gindel, Brookville, N.Y.

[73] Assignee: Alsy Manufacturing Inc., Hicksville, N.Y.

[21] Appl. No.: 1,725

[22] Filed: Jan. 8, 1979

[51] Int. Cl.[3] ..... A47B 55/02

[52] U.S. Cl. ..... 108/111; 211/181

[58] Field of Search ..... 108/111, 91, 101, 189, 108/109; 211/181

[56] References Cited

U.S. PATENT DOCUMENTS

| | | | |
|---|---|---|---|
| 893,786 | 9/1908 | Collis | 211/181 |
| 1,522,876 | 1/1925 | Genebach | 211/181 |
| 2,970,702 | 2/1961 | Maslow | 211/181 |
| 3,184,075 | 5/1965 | Cohen | 211/181 |
| 3,252,434 | 5/1966 | Young | 108/111 |
| 3,502,225 | 3/1970 | Oliver | 211/181 |
| 3,534,519 | 10/1970 | James | 108/111 |
| 3,998,170 | 12/1976 | Gordon | 108/91 |
| 4,127,072 | 11/1978 | Le Pon | 108/111 |

*Primary Examiner*—Francis K. Zugel

*Attorney, Agent, or Firm*—Lackenbach, Lilling & Siegel

[57] ABSTRACT

This invention relates to a new and novel single unit shelf construction and to a multi-shelf assembly and comprises wire shelves having a pair of closely-spaced transverse connection ribs at each of its distal ends. A pair of vertical supports have a transverse connection rib at each distal end. The distal ends of each of the connection ribs are bent so that they are parallel to the remaining portion of the connection rib. A clamp with a central hole is positioned on top of the connection ribs of the shelf. A second clamp with a threaded central hole is positioned underneath the connection rib and the distal ends of the connection rib of the vertical support; and fastening means are used to securely urge the clamps together so as to secure together a single unit shelf unit or a multi-shelf assembly.

25 Claims, 3 Drawing Figures

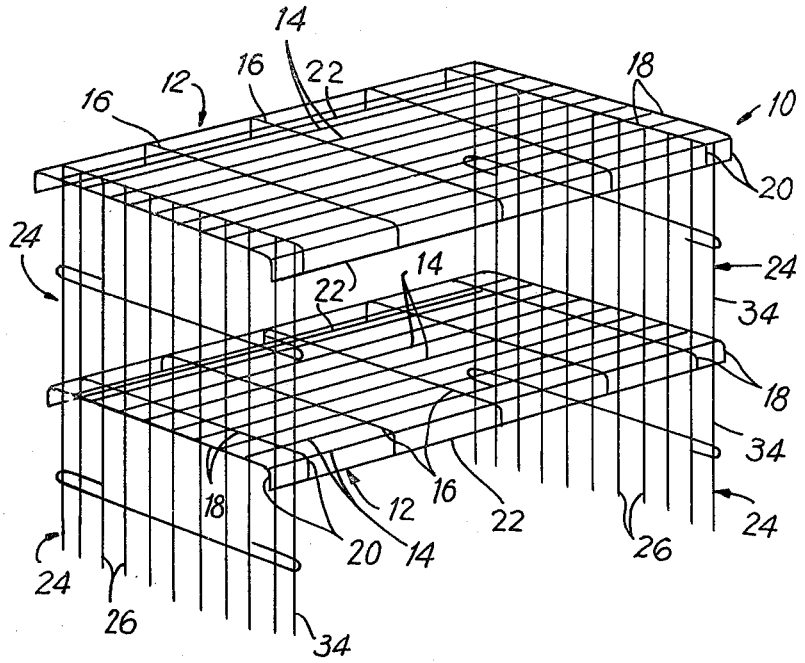
FIG. 1
FIG. 2
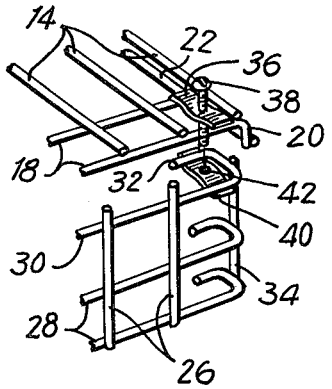
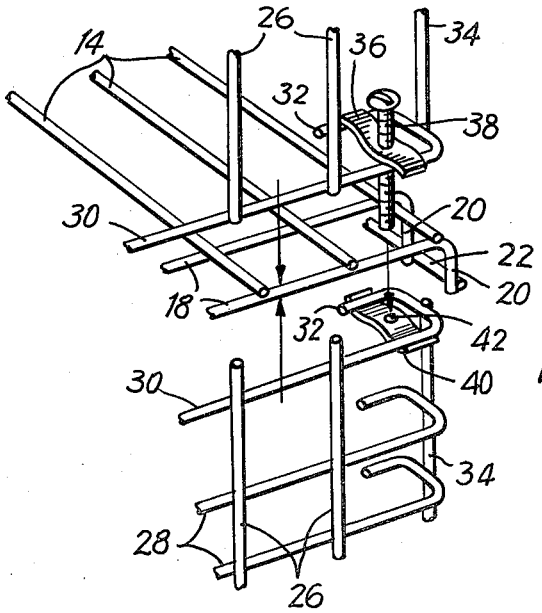
FIG. 3

SHELF ASSEMBLY

FIELD OF THE INVENTION

This invention relates to improvements in the construction of shelfing comprising vertical supports and horizontally-disposed shelves. Shelving assemblies, such as single or multi-shelf structures made with this type of construction can be easily assembled and disassembled as required.

One of the recurring problems of present day "knock-down" shelf assemblies is that there is no simple way to construct a stack of horizontal shelves. All of the known structures are somewhat sophisticated and require some minimum amount of mechanical ability. Presently, there is no "knock-down" shelf assembly which can be assembled and disassembled by a simple layman.

DESCRIPTION OF THE PRIOR ART

Examples of prior art United States patents dealing with various shelf assemblies are U.S. Pat. Nos. 3,225,720; 3,316,864; 3,589,746; 3,636,893; 3,763,793 and 3,765,634. The earlier Maslow U.S. Pat. No. 3,225,720 discloses a corner brace and notches made in the vertical supporting frame in order to permit the shelf to be positioned between the vertical supports. Stiffeners are used to provide the necessary rigidity and expansion elements are used to provide the necessary compressive forces to effect a secure coupling between the shelf and the support frames. A generally U-shaped clip is used to connect two shelves together.

In the other Maslow patent (U.S. Pat. No. 3,316,864), there is disclosed a V-shaped clip for securing shelves to vertical supports and one of these clips is positioned in each of the four vertical supports. Each of the four corners of the shelf rests on a respective clip, and with such an arrangement, one is able to adjust the vertical position of the shelves.

U.S. Pat. No. 3,589,746 to Inglis discloses an assembly of a wire shelf cart. Each of the shelves is provided along its opposite longitudinal sides with a C-shaped channel or side member and each of these channel members is provided with rectangular openings adjacent the ends thereof. The width of this channel opening corresponds to the width of the vertical support. An L-shaped mounting clip is secured in the channel opening and the vertical support is secured to this L-shaped mounting clip. The Lange patent (U.S. Pat. No. 3,363,893) shows still another type of connection for a shelf arrangement. Closure caps are inserted into the ends of the supports. Each of these shelves has a cutout portion at its distal ends. In order to effect assembly, two adjacent shelves have their cut-out portions positioned between two opposing supports and screw means are used to tighten the entire assembly together.

U.S. Pat. No. 3,763,793 to Fleck discloses a rather complex method of assembling wire shelf units end to end. No disclosure is made of assembling a vertical stack of shelves. Adjacent shelves are connected together by means of an elongated clip with an anchor pad. The elongated clip is received within axially aligned side rails provided on each of the shelves. In the Stempel patent (U.S. Pat. No. 3,765,634) there is disclosed a joiner support for connecting two shelves together. Basically, it is designed for the interconnection of two shelves being hung at the same level on a wall. The joiner support consists of two identical shell halves.

Each shell half consists of a squared, flat plate portion with a peripheral lip projecting laterally perpendicular to the plate portion. Slots are provided in the shell halves to permit the passage of the stringers of the shelves. Also, semicircular recesses are provided on each half to allow for the passage of the rods of the respective shelves. Partitions and bridges are provided in the shell halves to trap the ends of the rods so that they cannot easily move and movement of the stringers is prvented by the slots.

All of such prior art type of shelf units are generally complex and expensive and difficult to erect without the need of a tool(s) and/or a handyman. With today's modern living, shelving must be of such a simplified design that even women and children should be capable of easily assembling the shelf units, not only for the office and home, but also for any type of installation.

SUMMARY OF THE INVENTION

Accordingly, it is therefore an object of the invention to provide a construction of a "knock-down" shelf assembly which can be easily assembled and disassembled by a common layman.

Such a unique and novel assembly consists of shelves which have two parallel, spaced transverse rods at each end. Vertical supports of the assembly include at their opposite ends a horizontal rod which has end portions bent so as to be in a position in parallel with the central portion of the rod. Sinusoidally-shaped clamps are used in conjunction with fastening means to secure the shelf to the vertical supports.

BRIEF DESCRIPTION OF THE DRAWINGS

FIG. 1 is a perspective view of an assembled shelving unit or construction of the invention;

FIG. 2 is a fragmentary view showing the construction of a shelf and a vertical support; and FIG. 3 is a greatly enlarged, exploded view showing the construction of a shelf and two vertical supports.

DETAILED DESCRIPTION OF THE INVENTION

Referring now to the drawing, and particularly to FIG. 1, the assembled shelving unit may comprise a multi-shelf arrangement 10 or may comprise a single shelf unit and either embodiment can be used to support most items of a size that will not slip through the slots between the rods making up the shelves. The wire shelves can, of course, be of the conventional type, but important design alterations are necessary for forming the shelf components of the present invention. Generally, the supporting surface of the shelf 12 is made up of a plurality of parallel-spaced longitudinal rods 14, and a plurality of parallel-spaced transverse rods or ribs 16 which are appropriately positioned to secure the rods 14 in a fixed relationship and to insure rigidity of the shelf 12. On each end of the shelf 12, a pair of parallel-spaced transverse connection ribs 18 are positioned. These ribs 18 are similar to the ribs 16, but are preferably positioned relatively close to each other and the outer rib of the two should be at the distal end of the longitudinal rods 14. Each of the transverse ribs 16 and the connection ribs 18 have both their distal ends 20 bent generally at right angles in a downward direction. A further longitudinal rib 22 is connected and secured to these bent distal end portions 20 of the ribs 16 and 18 on both sides of each shelf unit to provide even further strength and rigidity to the shelf structure.

The side or vertical supports 24 are formed of a plurality of parallel-spaced vertical rods 26 secured and connected to a plurality of transverse ribs 28, which together provide strong supports for each shelf 12 and insure the overall rigidity of the vertical side supports. At each end of the vertical supports 24, a connection rib 30 is secured transversely of the vertical rods 26, similar to the transverse ribs 28. Both distal ends 32 of each connection rib 30 are bent so that they form a U-shape and the extreme tips or ends thereof are parallel to the connection rib 30 itself. Vertical ribs 34 are secured to and connected to the bent portions of the distal ends 32 of the connection ribs 30.

FIG. 2 illustrates the manner in which a single shelf 12 is connected to each of the vertical supports 24. Firstly, with the shelf 12 positioned on the vertical support 24, the rods 14 will be aligned with their respective vertical rods 26. Then, clamping means, suitably formed by upper clamps 36 are placed on the opposite ends of the connection ribs 18 of the shelf 12. Each of these clamps 36 are made of a heavy metal plate and are shaped with three concavities, forming a generally sinusoidal-like shape to the plate such that the outer concavities fit snugly and securely on the connecting ribs 18. These upper clamps are provided with a central opening through which a suitable fastener or like connecting device, such as a screw 38, can pass. Matching lower clamps 40 are placed at both ends underneath the connection rib 30 and its bent distal end 32. The clamps 40 have a shape similar to that of the clamps 36, except that they are suitably provided with a threaded central hole 42. To secure the shelf to the vertical assembly, a conventional threaded fastener, such as a bolt or the like may be used. As shown herein a round head screw 38 passing through the hole in the clamp 36 is threaded into the hole 42 of the clamp 40. After the screw has been tightened, the shelf 12 will be securely connected to the end or side vertical supports 24. The further end longitudinal ribs 22 of the shelf 12 insure that there will be no lateral or transverse movement of the shelf with respect to the vertical supports 24.

FIG. 3 illustrates the manner in which a single shelf 12 can be connected to two vertical supports 24. Such an arrangement may be employed with respect to a multi-shelf arrangement. As can be seen from the drawing, the only difference between this connection and the former connection is that the upper clamp 36 is positioned on top of the connection rib 30 and its distal end 32 of the top vertical support 24 and not on the connection ribs 18 of the shelf 12 per se. Otherwise, the assembly is basically identical to that one shown and described in connection with FIG. 2.

It is important to recognize that the "parallel" clamps when locked together provide an extremely rigid structure to the overall shelf assembly. They prevent all movement between each wire shelf 12 and the vertical supports 24 by virtue of their shape and the fact that they grip pairs of opposing parallel transverse ribs and distal end portions of other connection ribs. The concavities of the clamps provide the groove means by which the ribs, etc. are immovably held in a fixed position. Such structural detail as well as the fact that opposing parallel pairs of clamps are used provide better stability to the shelf assembly and lend greater flexibility to the shelving assembly for assembling various arrangements of the structure with the devices of the present invention.

It will be appreciated that with the construction shown in FIGS. 2 and 3 of the drawing, only two of the examples possible with applicants' novel and unique method of assembly are illustrated. For example, it is possible to use this invention in setting up a staggered shelving assembly. That is, an assembly which has a shelf extending to one side of the vertical support and another shelf extending on the other side of the vertical support. Still other types of arrangements can be realized which come with the scope of applicants' invention.

Also, different types of screw means may be utilized with the invention. For instance, an assembly in which the bottom clamp 40 does not have a threaded hole may be employed. Alternatively, a nut or other like means may be threaded onto the end of the screw 38. Other types of fasteners, such as one-way anchor type bolts, may be employed.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended. For example, the pair of transverse ribs at each end of a shelf may comprise a long rib and oppositely disposed short ribs at the corners where they are required. If the short ribs are connected as one rib, they would form a single rib parallel to the long rib as is described hereinabove. Also, although the bent end portions of the shelves on the front and rear thereof are not absolutely necessary, they also preclude transverse movement of the shelves and also contribute to the overall rigidity of the shelves and the entire shelf assembly. The bent portions of the ribs on the vertical supports may be rigidly secured to one of the plurality of vertical rods to stiffen the bent end portions of the transverse ribs to resist flexing and movement of the shelf unit. As will be understood by those skilled in the art, the bars and/or ribs of the shelves and vertical supports can be of any suitable rigid material, such as metal, engineering plastics, wood and the like. In the cross-sectional shape thereof, the bars or ribs could be of any desired shape and are preferably circular. Also, the means clamped between the clamps are preferably of a cross-sectional size large enough to resist bending, flexing or twisting so as to provide a strong, rigid structure to the unit or device of the invention. It should also be noted that the shelves of the invention do not employ any cross-bracing or other supports and that each shelf structure is simply based on three pieces or elements fastened together without any extra parts.

What is claimed is:

1. A shelving assembly having at least one horizontal wire shelf, and vertical supports, both formed of intersecting wires secured together and said shelf comprising: a pair of closely-spaced transverse connection ribs at opposite ends of each said wire shelf; a pair of vertical supports for each said wire shelf and each support having a transverse connection rib on at least one of its ends, distal end portions of said transverse connection rib of said vertical supports being bent so as to be disposed parallel to the adjacent portion of said transverse connection ribs; pairs of clamping means having apertures adapted to secure together each of said pair of transverse connection ribs of a wire shelf to a transverse connection rib and the distal ends thereof of each said vertical support; each of said clamping means comprising first and second clamps and fastener means, said first clamps being positioned on and bridging across each said pair of transverse connection ribs of said wire shelf, the second clamps being positioned on and bridging across said transverse connection rib and said distal end portions thereof of each said vertical support, and said fastener means passing through said clamping means and urging said first and second clamps tightly together in a generally parallel relation so as to form an overall rigid and sturdy shelf structure.

2. A shelving assembly according to claim 1, further comprising nut means adapted to be threaded onto a threaded distal end portion of said fastener means.

3. A shelving assembly according to claim 2, wherein said shelf includes a plurality of parallel and longitudinally disposed wire ribs.

4. A shelving assembly according to claim 1, wherein said fastener means is threaded and one of said apertures of said clamping means defines complementary threads for removable engagement with said fastener means.

5. A shelving assembly according to claim 4, wherein said shelf includes a plurality of parallel and longitudinally disposed wire ribs.

6. A shelving assembly according to claim 1, wherein said fastener means is disposed between said transverse connection ribs and between said parallel adjacent portions of said transverse rib of said vertical support.

7. A shelving assembly according to claim 1, wherein the spacing between said closely-spaced transverse connection ribs and said adjacent parallel portions of said transverse rib of said vertical support is substantially the same.

8. A shelving assembly according to claim 1, wherein said clamps are complementary in shape and wherein each clamp includes at least two spaced concave portions disposed transversely to said clamps and parallel to each other.

9. A shelving assembly according to claim 1, wherein said transverse connection ribs are parallel to each other.

10. A shelving assembly having at least two horizontal wire shelves and vertical supports, each formed of intersecting wires secured together and said wire shelf comprising: a pair of transverse connection ribs at opposite ends of each said wire shelf; pairs of vertical supports for each said wire shelf and each support having a transverse connection rib on at least one of its ends, distal end portions of said transverse connection rib of said vertical supports being bent so as to be disposed parallel to the adjacent portion of said transverse connection rib; pairs of clamping means having apertures adapted to secure together each of said pair of transverse connection ribs of a wire shelf to a transverse connection rib and the distal ends thereof of each said vertical support; each of said clamping means comprising upper and lower clamps and fastener means, said upper clamps being positioned on and bridging across said transverse connection rib and said distal end portions thereof of each upper vertical support, the lower clamps being positioned underneath and bridging across said transverse connection rib and the distal ends thereof of each lower vertical support, and said fastener means passing through said clamping means and urging said upper and lower clamps tightly together in a generally parallel relation so as to form an overall rigid and sturdy shelf structure.

11. A shelving assembly according to claim 10, further comprising nut means adapted to be threaded onto a threaded distal end portion of said fastener means.

12. A shelving assembly according to claim 11, wherein said shelf includes a plurality of parallel and longitudinally disposed wire ribs.

13. A shelving assembly according to claim 10, wherein said fastener means is threaded and one of said apertures of said clamping means defines complementary threads for removable engagement with said fastener means.

14. A shelving assembly according to claim 13, wherein said shelf includes a plurality of parallel and longitudinally disposed wire ribs.

15. A shelving assembly according to claim 10, wherein said fastener means is disposed between said transverse connection ribs and between said parallel adjacent portions of said transverse rib of said vertical support.

16. A shelving assembly according to claim 10, wherein the spacing between said transverse connection ribs and said adjacent parallel portions of said transverse ribs of said vertical support is substantially the same.

17. A shelving assembly according to claim 10, wherein said clamps are complementary in shape and wherein each clamp includes at least two spaced concave portions disposed transversely to said clamps and parallel to each other.

18. A shelving assembly having a plurality of horizontal shelves, each formed of intersecting wires secured together and said shelving comprising: an upper section and a plurality of intermediate sections with each section of shelving including a wire shelf and a pair of vertical supports; each of said wire shelves having a pair of transverse connection ribs at opposite ends of each said wire shelf; each of said vertical supports having a transverse connection rib on at least one of its ends, and the distal end portions of said transverse connection rib of said vertical supports being bent so as to be disposed parallel to the adjacent portion of said transverse connection rib; pairs of clamping means comprising fastener means and upper and lower clamps, and each of said clamps having apertures adapted to receive said fastener means for securing together each of said wire shelves to one or two pairs of vertical supports; the wire shelves of said upper section of said shelving assembly being assembled to a pair of vertical supports by upper clamps positioned on and bridging across each said pair of transverse connection ribs of a wire shelf, and by lower clamps positioned underneath and bridging across said transverse connection rib and said distal end portions thereof of a pair of vertical supports with said fastener means passing through said clamping means and urging said upper and lower clamps of said upper section to clamp tightly together in a generally parallel relation; and the wire shelves of said intermediate sections of said shelving assembly each being assembled to two pairs of vertical supports by upper clamps positioned on and bridging across said transverse rib and said distal end portions thereof of a first pair of vertical supports, and by lower clamps positioned underneath and bridging across said transverse connection rib and the distal ends thereof of a second pair of vertical supports coaxially disposed beneath said first pair of vertical supports, and said fastener means passing through said clamping means and between said transverse connection ribs of said wire shelf disposed between said first and second pairs of vertical supports so as to urge said upper and lower clamps tightly together in a generally parallel relation so as to form an overall rigid and sturdy shelf structure.

19. A shelving assembly according to claim 18, further comprising nut means adapted to be threaded onto a threaded distal end portion of said fastener means.

20. A shelving assembly according to claim 19, wherein said shelf includes a plurality of parallel and longitudinally disposed wire ribs.

21. A shelving assembly according to claim 18, wherein said fastener means is threaded and one of said apertures of said clamping means defines complementary threads for removable engagement with said fastener means.

22. A shelving assembly according to claim 21, wherein said shelf includes a plurality of parallel and longitudinally disposed wire ribs.

23. A shelving assembly according to claim 18, wherein the spacing between said transverse connection ribs and said adjacent parallel portions of said transverse rib of said vertical support is substantially the same.

24. A shelving assembly according to claim 18, wherein said clamps are complementary in shape and wherein each clamp includes at least two spaced concave portions disposed transversely to said clamps and parallel to each other.

25. A shelving assembly according to claim 18, wherein said transverse connection ribs are parallel to each other.

* * * * *